United States Patent [19]

Nishimura

[11] Patent Number: 4,990,755

[45] Date of Patent: Feb. 5, 1991

[54] HEATABLE SHEET ASSEMBLY

[76] Inventor: Makoto Nishimura, 3-10-10, Omori Nishi, Ota-ku, Tokyo, Japan

[21] Appl. No.: 358,402

[22] Filed: May 26, 1989

[30] Foreign Application Priority Data

Dec. 6, 1988 [JP] Japan ..... 63-158041[U]

[51] Int. Cl.[5] ..... H05B 3/38

[52] U.S. Cl. ..... 219/553; 219/549

[58] Field of Search ..... 219/548, 213, 548, 549, 219/552, 553, 543, 527

[56] References Cited

U.S. PATENT DOCUMENTS 4,250,397 2/1981 Gray ..... 219/527
4,301,356 11/1981 Tanei ..... 219/553
4,616,125 10/1986 Oppitz ..... 219/553

*Primary Examiner*—Roy N. Envall, Jr.
*Attorney, Agent, or Firm*—Limbach, Limbach & Sutton

[57] ABSTRACT

A heatable sheet assembly comprises a sheet to be electrically heated, electrically conductive metal foils applied to both surfaces of the sheet and an electrical terminal attached to each of the metal foils.

11 Claims, 2 Drawing Sheets

HEATABLE SHEET ASSEMBLY

BACKGROUND OF THE INVENTION

Field of the Invention

This invention relates to a heatable sheet assembly and, more particularly, to a heatable sheet assembly which can be cut to any desired shape and which possesses, above all, heat storage capabilities.

In the prior art, there are a variety of proposals with respect to a heatable sheet assembly containing carbon fibers and adapted to be utilized in, for example, floor heaters, horticultural equipments, bedding, health appliances or cattle sheds. For example, there is disclosed in Japanese Laid-open Patent Publication No.18702/1975 a paper-like composition containing acrylonitrile type synthetic resin pulp and carbon fibers. There is also disclosed in Japanese Laid-open Patent Publication No.281293/1987 a heatabale sheet obtained by mixing carbon fibers and natural pulp by the paper making technique.

The conventional heatable sheet assembly has, however, a drawback that, since the electodes are mounted on its opposite sides on the same planar surface, it cannot be formed into, for example, a doughnut shape, although it can be formed into a quadrangle such a square or rectangle, and thus the shape of the heatable sheet assembly itself is restricted.

The conventional heatable sheet assembly has also a drawback that, since the electrodes are mounted on the same planar surface, the electrodes are spaced apart from each other, with the result that the electrical resistance of the heatable sheet assembly between the electrodes is increased and hence the stable electrical resistance and temperature characteristics in the heatable sheet assembly can be obtained with considerable difficulties.

In addition, there lacks up to now a heatable sheet assembly provided with electrodes that is endowed not only with the function of heat storage but also with the function of radiating far infrared rays.

SUMMARY OF THE INVENTION

It is a principal object of the present invention to provide a heatable sheet assembly that can be made into any desired shape and that possesses stable temperature and heat storage properties.

It is another object of the present invention to provide a heatable sheet assembly by which the desired temperature can be obtained with small power consumption and which is highly meritorious economically.

It is still another object of the present invention to provide a heatable sheet assembly that is endowed with both the function of excellent heat storage and the function of heating by radiation of far infrared rays.

The above and other objects of the invention will become apparent from the following description.

According to the present invention, there is provided a heatable sheet assembly comprising a sheet to be electrically heated, electrically conductive metal foils applied to both surfaces of the sheet and an electrical terminal attached to each of the metal foils.

PREFERRED EMBODIMENTS OF THE INVENTION

Figure 1:
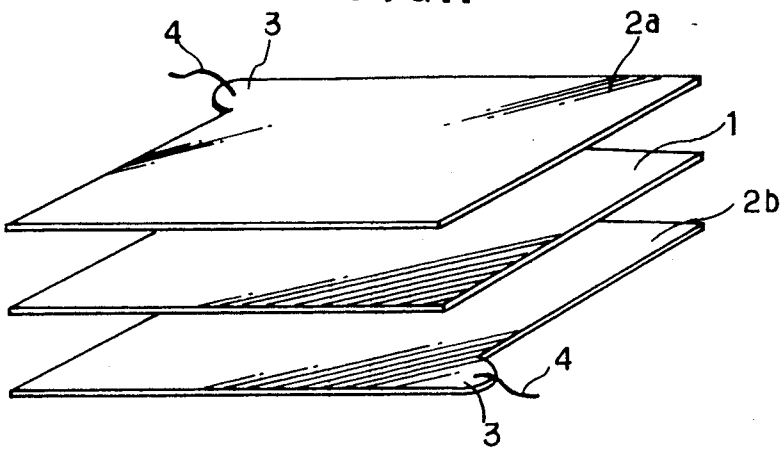
FIG. 1 is an exploded perspective view showing a preferred heatable sheet assembly according to the present invention.

The present invention will be explained in detail hereinbelow by referring to the drawings. It is noted that the present invention is not limited to the details shown and described herein in connection with the drawings.

Referring to FIG. 1, a sheet 1 to be heated may be heated at a desired temperature when a predetermined quantity of electricity is supplied thereto. The sheet 1 may be exemplified by a sheet of resin mixed or blended with carbon black, a cloth impregnated with a resin mixed or blended with carbon black, a sheet of carbon fibers and pulp produced by paper making technique, and a sheet of carbon fibers and pulp produced by paper making technique and impregnated with a resin.

The carbon fibers of the sheet produced by the paper making technique are preferably polyacrylonitrile type carbon fibers and/or pitch type carbon fibers. Most preferred are carbon fibers consisting of at least two different length fibers, namely fibers having the length not less than 3 mm and less than 5 mm and fibers having the length not less than 5 mm and fibers not more than 10 mm. Although there is no limitaion to the thickness of the carbon fibers, it is preferably 4 to 10 μm and more preferably 6 to 8 μm.

The pulp is preferably plant pulp, to which synthetic pulp may be admixed if so desired. The plant pulp may be preferably exemplified by wood fibers, seed wool fibers, bast fibers, leaf fibers and fibers of the Graminede family. The starting feed monomers for obtaining the synthetic pulp are preferably selected from the group consisting of acrylonitrile, vinyl acetate, vinyl chloride, vinylidene chloride, (meth)acrylic acid or (meth)acrylate, (meth)acrylamide, styrene, vinyl pyridine, vinyl monomers containing sulfone or sulfonate, allyl monomers containing sulfone or sulfonates, vinyl alcohol, and mixtures thereof. It is preferred that the thickness of the plant pulp and the synthetic pulp be not more than 100 μm and more desirably in the range of from 10 to 80 μm.

The sheet of carbon fibers and pulp may be produced by paper making technique in which the carbon fibers and the pulp are mixed and dispersed together. The mixing ratio of the carbon fibers and the pulp is preferably 3 to 20% by weight and more preferably 8 to 12% by weight of carbon fibers and 97 to 80% by weight of pulp and more preferably 92 to 88% by weight. If the contents of the carbon fibers are less than 3% by weight, the electrical resistance is increased and the desired heating temperature cannot be obtained. On the other hand, if the carbon fiber contents are in excess of 20% by weight, the dispersion ratio becomes worse and the stable electrical resistance cannot be obtained.

The resin contained in the sheet may preferably have heat deformation temperature of not lower than 60° C., and is selected from the group consisting of silicone resin, phenol resin, urea resin, melamine resin, polyester, epoxy resin, diallyl phthalate resin, vinyl chloride resin, polystyrene, SAN resin, ABS resin, methyl methacrylate resin, polypropylene, polyamide, polyacetal, polycarbonate, polyphenylene oxide, poly(4-methylpentene-1) and mixtures thereof.

An electrically conductive metal foil 2a having substantially the same shape and size as the heatable sheet 1 is affixed to the upper surface of the sheet 1 with an ordinary urethane or resin type adhesive, and another electrically conductive metal foil 2b similar to the foil 2a is affixed to the lower surface of the sheet 1. Although there is no limitation to the metal foils 2a, 2b, provided that they are electrically conductive, they are preferably selected from the group consisting of foils of aluminum, copper, nickel, stainless steel and mixtures thereof. On the other hand, althugh the thickness of the electrically conductive metal foils 2a, 2b may be changed in the range of from several μm to several mm, if so desired, it is preferably in the range of from 30 to 100 μm in order to render the heatable sheet assembly more flexible.

Each of the electrically conductive metal foils 2a, 2b is provided with an electrical terminal 3 and an electrical conductor 4. When the current of predetermined intensity is caused to flow in the conductor 4, the current flows through the heatable sheet 1 in the vertical direction or in the direction of thickness of the sheet 1 to heat the sheet 1 to a predetermined temperature. The metal foils 2a, 2b of substantially the same size and shape as the sheet 1 give rise to the favorable function of storing the heat emanating from the heated sheet 1.

There is no limitation to the mounting position of the electrical terminals 3, provided that they are in contact with the electrically conductive metal foils 2a, 2b. Thus, the terminals 3 may be formed integrally with the metal foils 2a, 2b, as shown in FIG. 1, or produced separately and subsequently attached to the foils.

Figure 2:
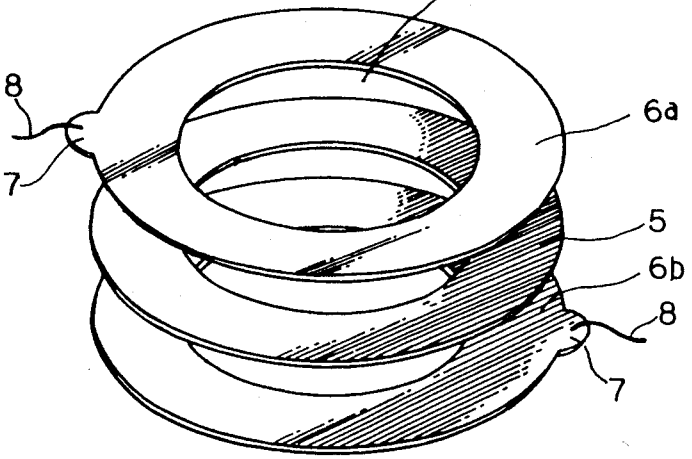
FIG. 2 is an exploded perspective view showing another preferred heatable sheet asembly according to the present invention.

FIG. 2 is an exploded perspective view of a heatable sheet assembly in a doughnut shape. The numeral 5 denotes a heatable sheet and the numerals 6a, 6b denote doughnut-shaped electrically conductive metal foils affixed to the upper and the lower sides of the heatable sheet 5, respectively. For producing a sheet assembly composed of the heatable sheet 5 and the electrically conductive metal foils 6a, 6b affixed thereto, the electrically conductive metal foils 2a, 2b are affixed to the heatable sheet 1 described in connection with FIG. 1, and the sheet 1 and the metal foils 2a, 2b are cut to have a circular shape. The central portion of the sheet-foil assembly is then punched, such as with a puncher, to form an inner hollow portion 9 to form a doughnut-shaped heatable sheet assembly In other words, cutting may be made to any desired shape from the square or rectangular sheet-foil assembly of the basic form which is not yet provided with the electrical terminals, as shown in FIG. 1. The electrical terminal 7 and the conductor 8 are then provided to each of the electrically conductive metal foils 6a, 6b, as shown in FIG. 2, to produce a heatable sheet assembly of any desired shape, inclusive of the doughnut shape.

Figure 3:
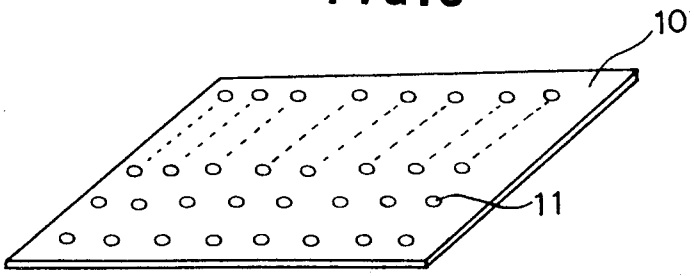
FIG. 3 is a perspective view showing a preferred electrically conductive metal foil employed in the present invention.

FIG. 3 is a perspective view showing a modification of the electrically conductive metal foil 10. The foil 10 is provided with a multiplicity of through-holes 11 for preventing interlayer exfoliation between the sheet and the metal foil 10 and transmitting the heat from the heated sheet more efficiently. The diameter of the through-hole may be changed depending on the size and the thickness of the sheet. For preventing the interlayer exfoliation, the electrically conductive metal foil 10 is affixed to the heatable sheet, in place of the metal sheets 2a, 2b, 6a, 6b shown in FIGS. 1 or 2, and the aforementioned resin having the thermal deformation temperature of not lower than 60° C. is then applied to the metal foil 10. The coated resin is effective to affix the heatable sheet 1, 5 and the electrically conductive metal foil 10 to each other at the contact points between the sheet 1, 5 and the electrically conductive metal foil 10 and at the positions of the through-holes 11 to prevent the interlayer exfoliation from occurring. The resin may be applied by lamination, as an example. The resin coating is effective not only to prevent the interlayer exfoliation but to improve mechanical strength as well as weather-proof properties of the heatable sheet assembly. In addition to or in place of the above described resin coating, the heatable sheet assembly may be coated by a coating material selected from the group consisting of woven fabrics, non-woven fabrics and synthetic fibers such as acrylic or polyester fibers.

The heatable sheet assembly provided with the electrically conductive metal foil 10 having the through-holes 11 as shown in FIG. 3 exhibits, in addition to the function of heat storage proper to the foils 2a, 2b, 6a, 6b shown in FIGS. 1 and 2, the moderate heating function due to radiation from the through-holes 11 of the far infrared rays having the wavelength of 5 to 20 μm is attained.

Figure 4:
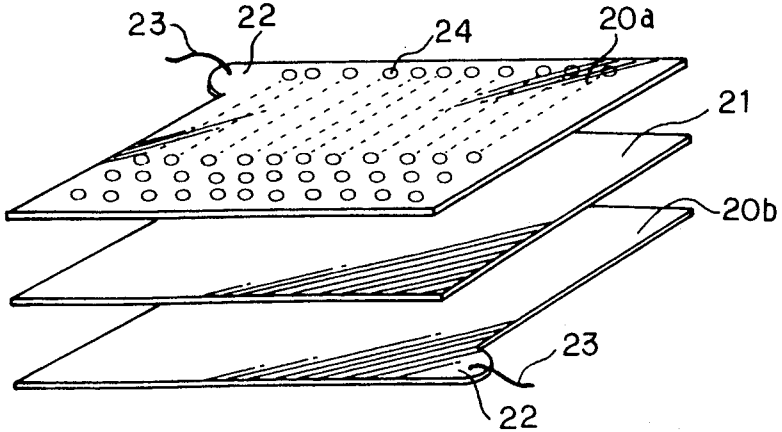
FIG. 4 is an exploded perspective view showing still another heatable sheet assembly according to the present invention.

In FIG. 4, an electrically conductive metal foil 20a provided with an electrical terminal 22 and an electrical conductor 23 and having a multiplicity of through-holes 24 is affixed to the upper surface of a heatable sheet 21, and another electrically conductive metal foil 20b provided with an electrical terminal 22 and an electrical conductor 23 is affixed to the lower surface of the sheet 21. That is, the electrically conductive metal foil 20a is similar to the electrically conductive metal foil 10 shown in FIG. 3, and the electrically conductive metal foil 20b is similar to the electrically conductive metal foils 2a, 2b shown in FIG. 1. Thus, by employing the combination of the electrically conductive metal foil 20a having a multiplicity of through-holes 24 and the electrically conductive metal foils not having the through-holes 24, the properties of heat storage and the function of moderate heating due to radiation of infrared rays may be exhibited more effectively.

Inasmuch as the heatable sheet assembly of the present invention includes the electrically conductive metal foils affixed to both surfaces of the heatable sheet, it can be fabricated very easily to have any desired shape and size, while the electrical terminals may be provided at any desired positions of the electrically conductive metal foils.

Also the current flows along the vertical direction of the sheet assembly, that is, along its thickness, so that the distance between the electrodes may be shortened as compared with the conventional system, and the electrial resistance may be reduced correspondingly. As a result, the temperature characteristics of the heatable sheet containing carbon fibers and plant pulp may be stabilized as compared with the conventional system, while the electrical losses are also reduced. In addition, the electrically conductive metal foil exhibits the heat storage function, so that the temperature about 10° C. higher than in the conventional system may be achieved for the same power consumption, thus providing a marked economical advantage. Moreover, the provision of a multiplicity of through-holes in the electrically conductive metal foil results in prevention of interlayer exfoliation between the heatable sheet and the electrically conductive metal foil while providing a moderate heating due to radiation of far infrared rays, in addition to the function of heat storage. The present heatable sheet assembly may be employed preferably in direct contact with the body of a user, for use in toilet seats, chairs or wearing apparel, because the more favorable functions of heat storage and moderate heating may be provided by the combination of the electrically conductive metal foil not having the through-holes and the electrically conductive metal foil having the through-holes.

EXAMPLES OF THE INVENTION

The present invention will be explained in more detail with reference to several Examples. It will be noted that these Examples are given for the sake of illustration and are not intended for limiting the invention.

Example 1

Figure 5:
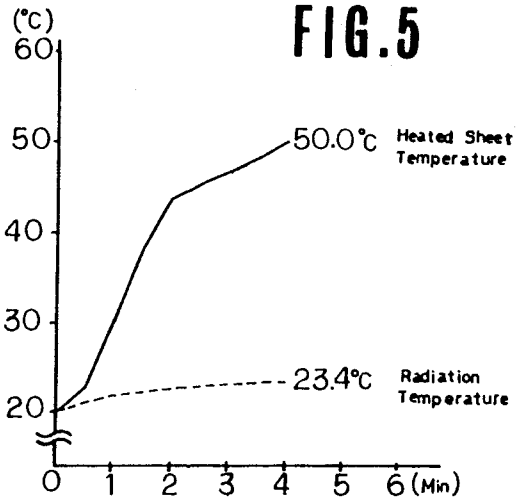
FIG. 5 is a chart showing radiation heat and heated sheet temperatures of the heatable sheet assembly obtained in Example 1.

0.8 g of polyacrylonitrile (PAN) type carbon fibers 8 mm long, 7.603 g of Manila pulp and 5.76 g of kraft pulp (N-BKP) were charged into a small-sized test mixer, together with water, and mixed under agitation for ten seconds for dispersing the components. Then, 0.8 g of PAN type carbon fibers 4 mm long were added to the system and the resulting mixture was further mixed under agitation for ten seconds. The produced liquid dispersion was poured into a tapping machine of 800×500 mm in size and formed into a sheet having the basis weight of 35 g/m$^2$ by employing the paper making technique. The sheet was then passed through a drying drum to produce a heatable sheet composed of carbon fibers and plant pulp and having a thickness of 95 μm. Then, a foil of stainless steel 800×500 mm in size and 50 μm in thickness was prepared and affixed to both sides of the sheet with an aluminum foil tape manufactured by KK. Teraoka Seisakusho. An electrical terminal fitted with an electrical conductor was then fitted to each of the stainless steel foils affixed to the sides of the sheet to produce a heatable sheet assembly. The radiation heat at a position spaced 20 cm from the produced heatable sheet assembly and the temperature of the heated stainless steel foil were then measured under the constant conditions of AC 100 V and 370 W. The radiation heat was measured using a radiation thermometer manufactured and sold by the KK. Horiba Seisakusho under the trade name of "IP-330", and the temperature of the sheet was measured using an electron thermometer manufactured and sold by KK. Sato Keiryo MFG under the trade name of "PC-8200". The results are shown in a graphic form in FIG. 5.

Example 2

Figure 6:
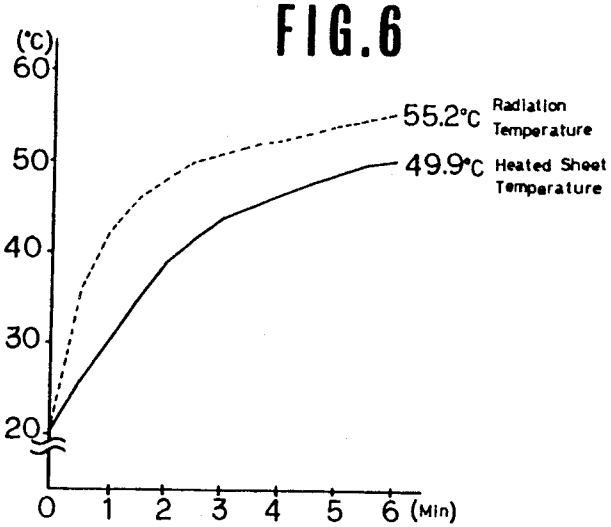
FIG. 6 is a chart showing radiation heat and heated sheet temperatures of the heatable sheet assembly obtained in Example 2.

A heatable sheet assembly was produced, and the radiation heat as well as the temperature of the heated sheet were measured in the same way as in Example 1, except that a stainless steel foil 800×500 mm in size and 50 μm in thickness having a multiplicity of through-holes 3 mm in diameter at a rate of nine through-holes per 10×10 cm was applied to the upper surface of the heatable sheet obtained in Example 1. The results are shown in a graphic form in FIG. 6.

Example 3

Figure 7:
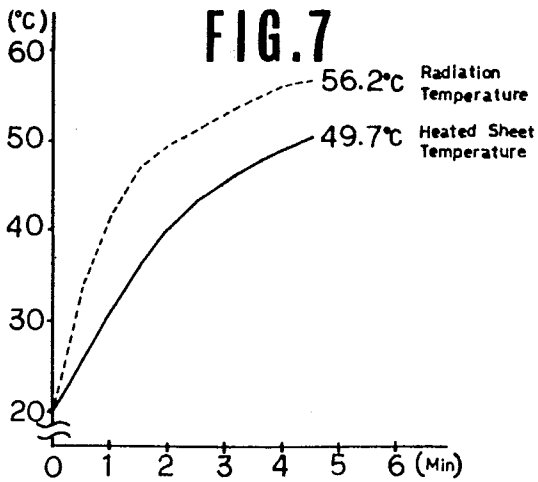
FIG. 7 is a chart showing radiation heat and heated sheet temperatures of the heatable sheet assembly obtained in Example 3.

A heatable sheet assembly was produced and the radiation heat as well as the temperature of the heated sheet were measured in the same way as in Example 1, except that a stainless steel foil 800×500 mm in size and 50 μm in thickness having a multiplicity of through-holes 3 mm in diameter at a rate of nine through-holes per 10×10 cm was applied to each of the upper and lower surfaces of the heatable sheet obtained in Example 1. The results are shown in a graph of FIG. 7.

Test Example 1

Figure 8:
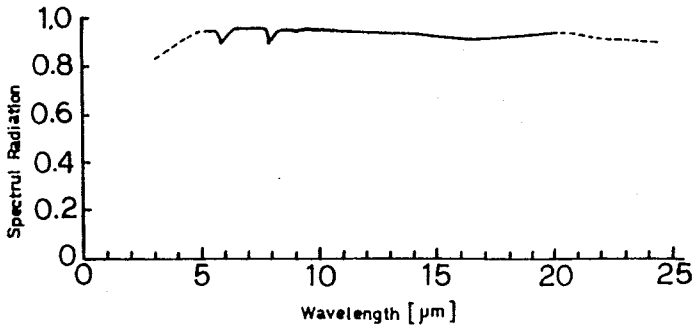
FIG. 8 is a chart showing the results of a far infrared ray radiation test conducted in Test Example 1.

The surface temperature of each of the heatable sheet assemblies produced in Example 2 and 3 was raised to 38° C. at the ambient temperature of 21.5° C., and the spectral radiation and the wavelength were measured at the upper side of the sheet assembly to which the stainless steel foil having a multiplicity of through-holes was affixed. It was now found that the far infrared rays having the wavelength of 5 to 20 μm were radiated at about 100%. The measured results are shown in a graph of FIG. 8.

It is thus seen from above that the heatable sheet assembly including the electrically conductive metal foils according to Example 1 which is affixed to both sides of a heatable sheet exhibits the function of excellent heat storage, while the heatable sheet assembly having an electrically heatable metal foil including a multiplicity of through-holes according to Example 2 which is affixed to one side of the sheet exhibits the function of heat storage and the function of moderate heating due to radiation of far infrared rays in a well-balanced manner. The effect of moderate heating due to radiation of far infrared rays, above all, may be produced with the heatable sheet assembly in which the electrically conductive metal foils each having a multiplicity of through-holes are affixed to both surfaces of the heatable sheet.

Although the present invention has been described with reference to the specific examples, it should be understood that various modifications and variations can be easily made by those skilled in the art without departing from the spirit of the invention. Accordingly, the foregoing disclosure should be interpreted as illustrative only and is not to be interpreted in a limiting sense. The present invention is limited only by the scope of the following claims.

What is claimed is:

1. A heatable sheet assembly comprising a sheet to be electrically heated, said sheet being selected from the group consisting of a sheet of carbon fibers and pulp produced by paper making technique, and a sheet of carbon fibers and pulp produced by paper making technique and impregnated with a resin, electrically conductive metal foils applied to both surfaces of said sheet and an electrical terminal attached to each of said metal foils, said sheet of carbon fibers and pulp containing at least carbon fibers of a first group having a length of not less than 3 mm and less than 5 mm and carbon fibers of a second group having a length of longer than 5 mm and not longer than 10 mm, and at least one of said metal foils having a multiplicity of through-holes.

2. The heatable sheet assembly according to claim 1 wherein the pulp contained in the sheet of carbon fibers and pulp is selected from the group consisting of plant fibers, synthetic fibers and mixtures thereof.

3. The heatable sheet assembly according to claim 2 wherein said plant pulp is selected from the group consisting of wood fibers, seed wool fibers, leaf fibers, bast fibers, fibers of the Graminede family and mixtures thereof.

4. The heatable sheet assembly according to claim 2 wherein a starting feed monomer of said synthetic pulp ia selected from the group consisting of acrylonitrile, vinyl acetate, vinyl chloride, vinylidene chloride, (meth)acrylic acid, (meth)acrylate, (meth)acrylamide, styrene, vinyl pyridine, vinyl monomers containing sulfone and sulfonate, allyl monomers containing sulfone and sulfonates, vinyl alcohol, and mixtures thereof.

5. The heatable sheet assembly according to claim 1 wherein the carbon fibers are contained in an amount of 3 to 20% by weight and the pulp is contained in an amount of 97 to 80% by weight.

6. The heatable sheet assembly according to claim 1 wherein the resin has a deformation temperature of not lower than 60° C.

7. The heatable sheet assembly according to claim 6 wherein the resin having the thermal deformation temperature not lower than 60° C. is selected from the group consisting of silicone resin, phenol resin, urea resin, melamine resin, polyester, epoxy resin, diallyl phthalate resin, vinyl chloride resin, polystyrene, SAN resin, ABS resin, methyl methacrylate resin, polypropylene, polyamide, polyacetal, polycarbonate, polyphenylene oxide, poly(4-methylpentene-1) and mixtures thereof.

8. The heatable sheet assembly according to claim 1 wherein metal of the electrically conductive metal foils is selected from the group consisting of aluminum, copper, nickel, stainless steel and mixtures thereof.

9. The heatable sheet assembly according to claim 1 wherein the sheet assembly is coated by a coating material selected from the group consisting of a resin having a 10 thermal deformation temperature of not lower than 60° C., woven fabrics, non-woven fabrics, synthetic fibers and mixtures thereof.

10. The heatable sheet assembly according to claim 9 wherein the resin having the thermal deformation temperature not lower than 60° C. is selected from the group consisting of silicone resin, phenol resin, urea resin, melamine resin, polyester, epoxy resin, diallyl phthalate resin, vinyl chloride resin, polystyrene, SAN resin, ABS resin, methyl methacrylate resin, polypropylene, polyamide, polyacetal, polycarbonate, polyphenylene oxide, poly(4-methylpentene-1) and mixtures thereof.

11. The heatable sheet assembly according to claim 9 wherein the synthetic fiber is selected from the group consisting of acrylic fibers, polyester fibers and mixtures thereof.

* * * * *